US005892494A

United States Patent [19]

Kimura et al.

[11] Patent Number: 5,892,494

[45] Date of Patent: Apr. 6, 1999

[54] CORRECTION OF LCD DRIVE VOLTAGE IN DEPENDENCE UPON LCD SWITCHING ELEMENT TURN ON TIME BETWEEN POLARITY CHANGES

[75] Inventors: Yasuhiro Kimura, Yamato; Satoru Nishi, Zama; Toshihiko Yoshida, Yokohama, all of Japan

[73] Assignee: International Business Machines Corporation, Armonk, N.Y.

[21] Appl. No.: 575,531

[22] Filed: Dec. 20, 1995

[30] Foreign Application Priority Data

Dec. 26, 1994 [JP] Japan ..... 6-323158

[51] Int. Cl.[6] ..... G09G 3/36

[52] U.S. Cl. ..... 345/96; 345/90; 345/99

[58] Field of Search ..... 345/87–92, 94–101

[56] References Cited

U.S. PATENT DOCUMENTS 5,506,599 4/1996 Iwama ..... 345/90

5,691,739 11/1997 Kawamori et al. ..... 345/94

*Primary Examiner*—Steven J. Saras
*Assistant Examiner*—Paul Bell
*Attorney, Agent, or Firm*—Ronald L. Drumheller

[57] ABSTRACT

In order to display an image on a liquid crystal display at a constant image quality independently of a change of the length of the period for applying voltages with the same polarity to the liquid crystal, the length of one cycle of a horizontal synchronizing signal inputted to an LCD unit from an information processor is counted and the amplitude of data voltage and the center of the amplitude are corrected so that the amplitude of the data voltage to be applied to the liquid crystal increases and a correction value for the center of the amplitude increases as the length of the period for applying data voltages with the same polarity to the liquid crystal decreases in accordance with the length of one cycle of the horizontal synchronizing signal and whether to perform gate overlap scan. Thereby, the absolute values (V) of inter-electrode voltages after the TFT is turned off are equalized independently of the polarity of data voltage to be applied to the liquid crystal both for a relatively long period and for a relatively short period.

6 Claims, 10 Drawing Sheets

CORRECTION OF LCD DRIVE VOLTAGE IN DEPENDENCE UPON LCD SWITCHING ELEMENT TURN ON TIME BETWEEN POLARITY CHANGES

BACKGROUND OF THE INVENTION

1. Field of the Invention

The present invention relates to a liquid crystal display driving method and a liquid crystal display driving apparatus, particularly to a driving method for driving a liquid crystal display provided with a display cell including a switching element, a pair of transparent electrodes arranged so as to face each other at a predetermined interval, and liquid crystal set between the pair of transparent electrodes and a driving apparatus to which the driving method can be applied.

2. Related Art

A liquid crystal display (LCD) has been known so far as a display unit for displaying an image such as a character or diagram among information processing units including a personal computer. In particular, an active matrix driven LCD constituted by arranging switching elements such as thin-film transistors (TFTs) like a matrix is able to securely control the density of picture elements and suited to display a quickly-moving dynamic image or a color image. Therefore, the LCD is considered to be prospective as a display unit to be substituted for a CRT. In the case of a TFT-type LCD, a plurality of sets of a TFT and a transparent electrode connected each other are formed like a matrix on one of a pair of transparent electrodes arranged so as to face each other and moreover, a plurality of gate lines for turning on a TFT for each string and a plurality of data lines for applying a voltage to liquid crystal through the turned-on TFT are arranged on it. Furthermore, a common electrode is formed on the whole surface of the other transparent electrode and the liquid crystal is sealed between the pair of transparent electrodes.

A TFT-type LCD driving circuit displays an image or the like on liquid crystal by applying a voltage to the gate lines to turn on TFTs for each string in order and applying a voltage (data voltage) with a level corresponding to the gradation of each picture element corresponding to a turned-on TFT string to the liquid crystal through each data line. When the TFTs are turned on, the light transmittance of the liquid crystal changes correspondingly to the level of the data voltage and electric charges are accumulated between electrodes. After the TFTs are turned off, the liquid crystal keeps the changed light transmittance by the accumulated electric charges. The service life of liquid crystal is shortened by continuously applying voltages with the same polarity to the liquid crystal. Therefore, the service life of the liquid crystal is lengthened by reversing the polarity of the data voltage every line or every frame to drive the liquid crystal according to the fact that the light transmittances of liquid crystal are equalized for applied voltages with the same absolute value even if the polarities of the voltage are different from each other.

As for a switching element of an TFT or the like, a parasitic capacitance C is present between a gate and a source as shown by a broken line in FIG. 11 and the potential of an electrode connected to the TFT is decreased by ΔV due to the parasitic capacitance C when the TFT is turned off. Therefore, the absolute value of the inter-electrode voltage after the TFT is turned off decreases by ΔV when the data voltage with the positive polarity (polarity for the TFT side to become positive) to the liquid crystal as shown in FIG. 12(A) and increases by ΔV when the data voltage with the negative polarity (polarity for the TFT side to become negative). Resultingly, the absolute value of the inter-electrode voltage fluctuates. Therefore, the position (center) of 0 V of the amplitude of the data voltage is corrected by ΔV and the inter-electrode voltage after the TFT is turned off is made constant independently of the polarity of the data voltage to prevent a screen from seizing due to flicker or deterioration of the liquid crystal.

Improvement of the so-called compatibility has strongly been requested for an LCD in recent years so that the LCD can be connected to various information processors and makes it possible to display an image in accordance with signals outputted from various information processors like a CRT. When an information processor displays an image on a display unit, image data signals for expressing the gradation of each picture element of an image to be displayed and timing signals such as a horizontal synchronizing signal and a vertical synchronizing signal for specifying display timing are outputted from the information processor. However, a horizontal scanning period (cycle of the horizontal synchronizing signal) or the like specified by the timing signals is not constant but it depends on the type of the information processor. An LCD driving circuit measures the timing of a gate-voltage applying time (on-time of a TFT) in accordance with the horizontal scanning period shown by an inputted timing signal. Therefore, when the horizontal scanning period changes, the on-time of the TFT changes and thus, a problem occurs.

That is, an TFT has a small electric-charge mobility (particularly, an a-Si TFT). Therefore, when the TFT is turned on, the current (charging current) flowing to an electrode from a data line through the TFT is relatively small and also, the change rate of an inter-electrode voltage is low. Moreover, the level of the charging current depends on the level of the gate voltage, source voltage, or drain voltage (data voltage) when turning on the TFT.

In general, a gate-on time is constant. Therefore, because the potential between a gate and a source gradually lowers in accordance with the movement of electric charges to liquid crystal when charging a data-side electrode to a positive polarity (see <1> in FIG. 11), the inclination of a change of the inter-electrode voltage (particularly, the inclination $\alpha 1$ at the end of charging: see FIG. 12) is small and the number of electric charges to be charged in a cell within a gate-on time decreases. However, when charging the data-side electrode to a negative polarity (see <2> in FIG. 11), the potential between the gate and the source gradually rises in accordance with the movement of electric charges to the liquid crystal. Therefore, the inclination of the change of the inter-electrode voltage (particularly, the inclination $\alpha 2$ at the end of charging: see FIG. 12) increases ($|\alpha 1|<|\alpha 2|$) and the number of electric charges to be charged in the cell increases.

As described above, the change rate of the inter-electrode voltage is relatively small and the change rate is fluctuated due to the polarity of the data voltage. Therefore, for example, when the horizontal scanning period specified by a timing signal inputted from an information processor is shortened (the on-time of an TFT is shortened), the absolute value of the inter-electrode voltage decreases as a whole independently of the polarity of the data voltage because the TFT is turned off before the inter-electrode voltage changes sufficiently as shown in FIG. 12(B). Moreover, because the change rate of the inter-electrode voltage is low when applying the data voltage with the positive polarity, the absolute value ($V_{NE}$) of the inter-electrode voltage further decreases. Therefore, the absolute value of the inter-electrode voltage changes correspondingly to the polarity of the data voltage and flicker, seizing of screen, or change of contrast occurs.

Moreover, when the horizontal scanning period is short compared to the change rate of the inter-electrode voltage, the so-called gate overlap scan (also known as double on pulse) may be performed in which data voltages with the same polarity are repeatedly applied to liquid crystal. The gate overlap scan is performed in order to simultaneously turn on each TFT of a display cell string after two lines to which data voltages with the same polarity are applied in driving a line when driving display cell strings connected to the same gate line by reversing the polarity of the data voltage to be applied to the strings every line and previously charge the display cell string after two lines. Thereby, the data voltage is applied to each display cell string half by half for two cycles of the horizontal scanning period in one-time screen scan. Therefore, it is possible to change the inter-electrode voltage to a voltage corresponding to the data voltage even when the change rate of the inter-electrode voltage is low.

By performing the above gate overlap scan, the period in which the data voltage is applied to each display cell increases twofold. When selectively performing the above gate overlap scan in accordance with the horizontal scanning period or the like in order to properly display an image by connecting an LCD to various information processors, the absolute value of the inter-electrode voltage fluctuates the same as the horizontal scanning period changes, and flicker, deterioration of liquid crystal, or change of contrast occurs even in accordance with whether to execute the gate overlap scan.

SUMMARY OF THE INVENTION

The present invention is made to solve the above problems and its object is to provide a liquid crystal display driving method and a liquid crystal display driving apparatus for displaying an image on a liquid crystal display at a constant image quality independently of a change of the length of the period for applying voltages with the same polarity to liquid crystal.

To achieve the above object, the present invention uses a liquid crystal display driving method for driving liquid crystal by alternately applying gradation voltages with positive and negative polarities to a switching element, comprising the steps of identifying a time length while the switching element is turned on, correcting the voltage level of the gradation voltage for each polarity in accordance with the identified time length, and equalizing absolute values of the voltages with positive and negative polarities applied to the liquid crystal while the switching element is turned off.

Moreover, the present invention uses a liquid crystal display driving method for displaying an image on a display cell by repeating the following operations—turning on a switching element of a liquid crystal display provided with the display cell including the switching element, a pair of transparent electrodes arranged so as to face each other at a predetermined interval, and liquid crystal set between the pair of transparent electrodes; applying a voltage with a predetermined polarity and a level corresponding to a gradation to be displayed by the display cell to the liquid crystal through the transparent electrode pair; and thereafter turning off the switching element for a predetermined period while reversing the polarity of the applied voltage when or whenever applying the voltage to the liquid crystal once or a plurality of times; comprising the steps of deciding the length of a second period while the voltage with the predetermined polarity is applied to the liquid crystal within a first period from the time when applying of the voltage with the predetermined polarity to the liquid crystal is started to the time when applying of a voltage with a polarity opposite to the predetermined polarity to the liquid crystal is started, changing the level of a voltage to be applied to the liquid crystal in accordance with the decided length of the second period, and correcting the level of the changed applied voltage for each polarity so that the absolute values of the voltages between the pair of transparent electrodes while the switching element is turned off are equalized when applying the changed voltage to the liquid crystal at a predetermined polarity and when applying the changed voltage to the liquid crystal at a polarity opposite to the predetermined polarity.

Furthermore, the present invention uses a liquid crystal display driving apparatus for driving liquid crystal by alternately applying gradation voltages with positive and negative polarities to a switching element, comprising means for identifying a time length while the switching element is turned on and means for correcting the voltage level of the gradation voltage for each polarity in accordance with the identified time length and thereby equalizing absolute values of the voltages with positive and negative polarities applied to the liquid crystal while the switching element is turned off.

Furthermore, the present invention uses a liquid crystal display driving apparatus for displaying an image on a plurality of display cells by repeating the following operations—turning on a switching element of each display cell of a liquid crystal display provided with a plurality of display cells including the switching element, a pair of transparent electrodes arranged so as to face each other at a predetermined interval, and liquid crystal set between the pair of transparent electrodes; applying a voltage with a predetermined polarity and a level corresponding to a gradation to be displayed by each display cell to the transparent electrode pair; and thereafter turning off the switching element for a predetermined period while reversing the polarity of the applied voltage when or whenever applying a voltage to the liquid crystal once or a plurality of times; comprising decision means for deciding the length of a second period while the voltage with the predetermined polarity is applied to the liquid crystal within a first period from the time when applying of the voltage with the predetermined polarity to the liquid crystal is started to the time when applying of a voltage with a polarity opposite to the predetermined polarity to the liquid crystal is started and correction means for changing the level of a voltage to be applied to the liquid crystal of each display cell in accordance with the length of the second period decided by the decision means and correcting the level of the changed voltage for each polarity so that the absolute values of the voltages between the pair of transparent electrodes while the switching element is turned off are equalized when applying the changed voltage to the liquid crystal at a predetermined polarity and when applying the changed voltage to the liquid crystal at a polarity opposite to the predetermined polarity.

Furthermore, it is preferable that decision means decides the length of a second period in accordance with the number of times in which a voltage with a predetermined polarity is applied to liquid crystal during a first period and the voltage applying time for each time.

Furthermore, it is preferable that decision means decides the voltage applying time for each time in accordance with a signal for specifying inputted display timing.

As for a liquid crystal display, the magnitude of electric charges (that is, light transmittance of liquid crystal) accumulated between transparent electrodes of a display cell depends on the electric charge mobility of a switching element and the time while a voltage is applied between electrodes. However, it also depends on the level of a voltage applied between electrodes. Moreover, it is known that the permittivity of liquid crystal changes correspondingly to the absolute value of a voltage applied between electrodes (dielectric anisotropy). Thus, a change ($\Delta V$) of the inter-electrode voltage when a switching element is turned off is changed due to the above phenomenon correspondingly to the level of the voltage applied between electrodes.

According to the above described, the present invention identifies a time length while a switching element is turned on and corrects the level of gradation voltage in accordance with the identified time length to equalize the absolute values of the voltages with positive and negative polarities applied to liquid crystal while the switching element is turned off. Thereby, even if a horizontal scanning period changes or the length of an on-period of the switching element (period for applying voltages with the same polarity to liquid crystal) changes in accordance with whether to execute gate overlap scan, the absolute value of the voltage applied to liquid crystal while the switching element is turned off becomes constant independently of the polarity of gradation voltage. Therefore, it is possible to display images with a constant image quality on a liquid crystal display without causing flicker, seizing of screen, or fluctuation of contrast.

More minutely, the above on-period is a period (second period) in which a voltage with a predetermined polarity is applied to liquid crystal during the first period from the time when applying of the voltage with the predetermined polarity to the liquid crystal is started to the time when applying of a voltage with a polarity opposite to the predetermined polarity is started. Therefore, by deciding the length of the second period, it is possible to change the level of a voltage to be applied to the liquid crystal correspondingly to the decided length of the second period (specifically, it is possible to change the level of the voltage so that it rises as the second period shortens).

The length of the second period can be decided in accordance with the number of times in which a voltage with a predetermined polarity is applied to liquid crystal and the voltage applying time for each time during the first period. Moreover, it is once that the voltage with the predetermined polarity is applied to the liquid crystal during the first period in driving of a general liquid crystal display. However, when performing the so-called gate overlap scan, the voltage is applied to the liquid crystal a plurality of times. Moreover, the voltage applying time for each time can be decided by measuring the length of a horizontal scanning period in accordance with a signal for specifying inputted display timing in the case of, for example, active matrix driving. As described above, even if the horizontal scanning period changes or the length of the second period changes in accordance with whether to execute the gate overlap scan, it is possible to keep the inter-electrode voltage almost constant.

As for the correction of the gradation voltage for each polarity, more minutely, it is possible to correct the level of the voltage changed as described above to be applied to the liquid crystal for each polarity so that the absolute values of the voltages between a pair of transparent electrodes while the switching element is turned off (off-period) are equalized when applying the voltage to be applied to the liquid crystal to the liquid crystal at a predetermined polarity and when applying the voltage to the liquid crystal at a polarity opposite to the predetermined polarity.

To prevent the absolute value of an inter-electrode voltage from fluctuating due to the fluctuation of the change rate of the inter-electrode voltage correspondingly to the polarity of an applied voltage, it is also possible to correct the level of the applied voltage for each polarity correspondingly to the change rate of the inter-electrode voltage different for each polarity of the applied voltage, correct the level of the applied voltage by changing it so that the change rate of the inter-electrode voltage becomes large enough for the length of the second period in any polarity of a voltage to be applied, or correct the level of the applied voltage by combining the above two methods.

DESCRIPTION OF THE PREFERRED EMBODIMENTS

An embodiment of the present invention is described below in detail by referring to the accompanying drawings.

Figure 1:
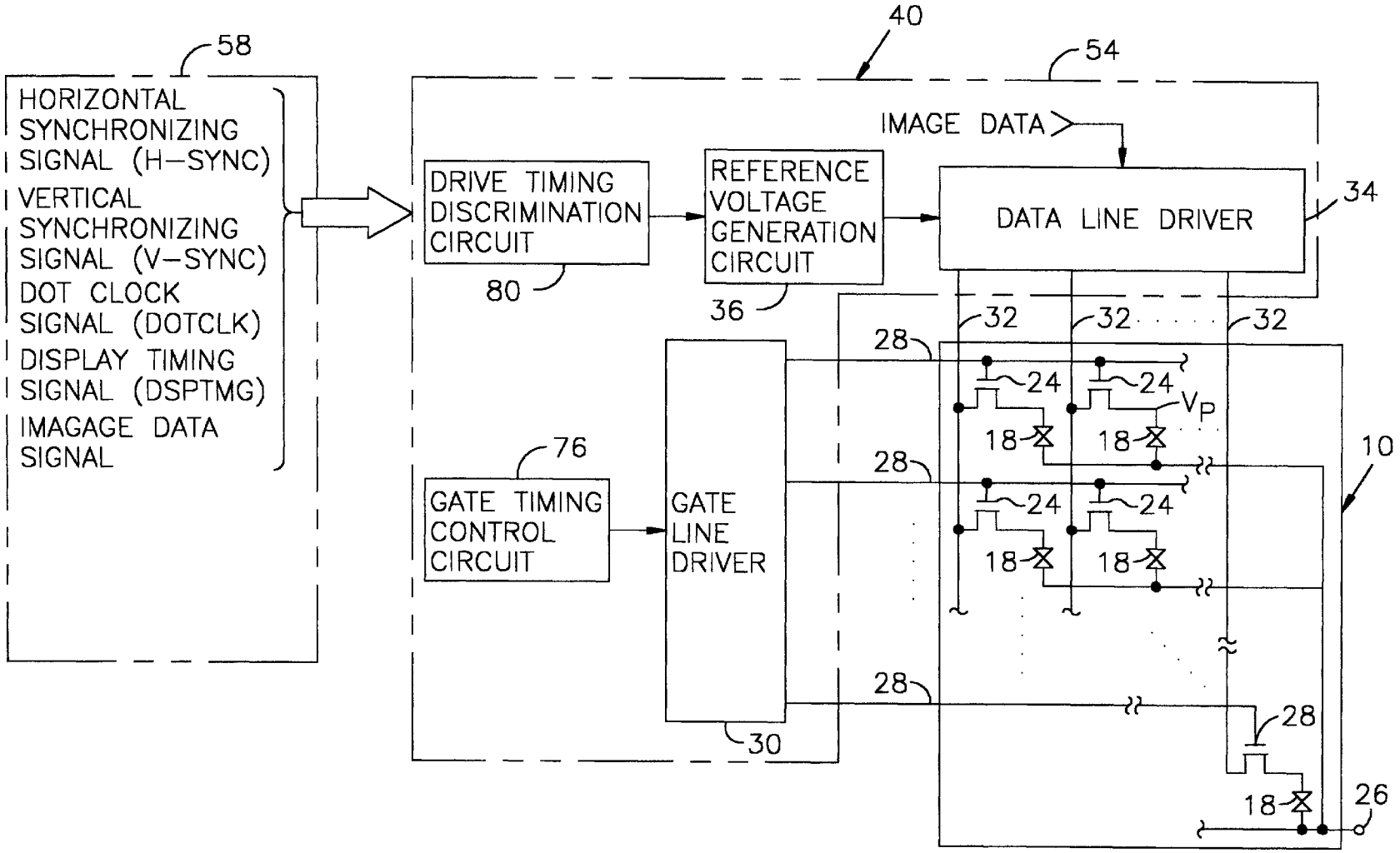
FIG. 1 is a schematic diagram showing the LCD and the LCD driving circuit of the present embodiment.

FIG. 1 shows a liquid crystal display unit (LCD unit) 40 of the embodiment. The LCD unit 40 comprises a driving circuit 54 serving as the driving apparatus for the liquid crystal display of the present invention and a liquid crystal display (LCD) 10 serving as the liquid crystal display of the present invention.

Figure 2:
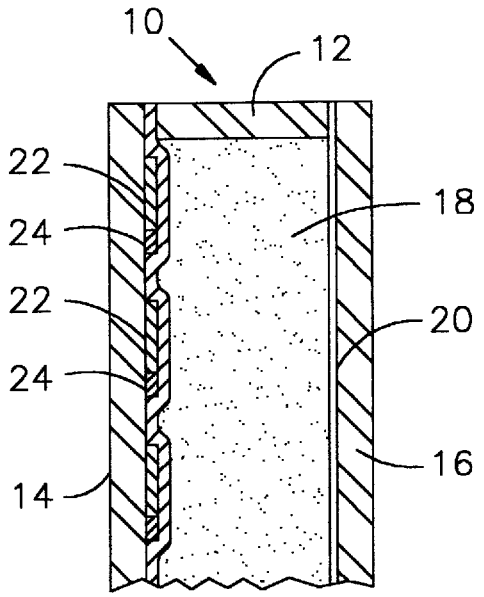
FIG. 2 is a sectional view of an LCD.
Figure 5:
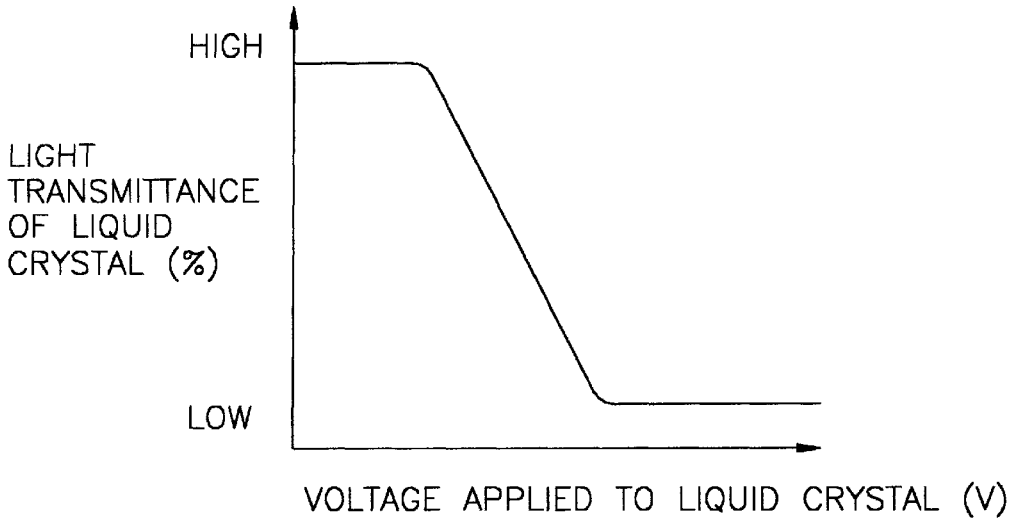
FIG. 5 is a diagram showing the relation between voltage applied to liquid crystal and light transmittance of the liquid crystal.

As shown in FIG. 2, the LCD 10 is provided with a pair of transparent substrates 14 and 16 arranged so as to face each other at a predetermined interval by a spacer 12 and liquid crystal 18 is sealed between the transparent substrates 14 and 16. The liquid crystal 18 of this embodiment uses liquid crystal having a negative dielectric anisotropy and provided with the characteristic that the light transmittance lowers as a voltage applied to the liquid crystal rises as shown in FIG. 5. A transparent electrode 20 is formed on the whole surface of the transparent substrate 16 contacting the liquid crystal 18. Moreover, thin-film transistors (TFT) 24 are arranged on the surface of the transparent electrode 14 contacting the liquid crystal 18 like a matrix (see FIG. 1) and a transparent electrode 22 is formed correspondingly to each TFT 24.

FIG. 1 schematically shows the circuit of the LCD 10. Though not illustrated, the above each electrode 22 is connected to the source of each TFT 24 and the liquid crystal 18 set between the electrode 22 and the electrode 20 (in FIG. 1, the electrode 20 is shown as a wire extending from one end of each of a plurality of pieces of the liquid crystal 18 shown in FIG. 1 to a common terminal 26). The plurality of pieces of the liquid crystal 18 shown in FIG. 1 correspond to one picture element of an image displayed on the LCD 10 and constitute the display cell of the present invention together with the TFT 24 and the electrodes 22 and 20. Moreover, in the case of this embodiment, the common terminal 26 connected to the electrode 20 is grounded and the potential of the electrode 20 is kept constant (at the ground level).

The LCD 10 is provided with a plurality of gate lines 28 extending in a predetermined direction at the transparent substrate 14 side and the gate of each TFT 24 is connected to any one of the gate lines 28. Each of the gate lines 28 is connected to a gate-line driver 30. Moreover, the transparent substrate 14 side of the LCD 10 is provided with a plurality of data lines 32 extending in a direction intersecting the gate lines 28 and the drain of each TFT 24 is connected to any one of the data lines 32. Each of the data lines 32 is connected to a data line driver 34.

The driving circuit 54 is connected to an information processor 58 comprising a personal computer or work station and receives a horizontal synchronizing signal (H-SYNC), a vertical synchronizing signal (V-SYNC), a dot clock signal (DOTCLK), a display timing signal (DSPTMG), and an image data signal showing an image to be displayed on the LCD 10 from the information processor 58. An image data signal is a signal obtained by superimposing data showing the gradation of each picture element of an image to be displayed at a certain time interval in series synchronously with a horizontal synchronizing signal and a vertical synchronizing signal. A dot clock signal is a clock signal with a frequency synchronizing with the data for each picture element superimposed on the image data signal. A display timing signal is a signal which is set to a high level during the period in which picture element data is superimposed on an image data signal and to a low level during periods other than the above period (so-called blanking period) in one cycle of a horizontal synchronizing signal.

The driving circuit 54 is provided with a gate timing control circuit 76. The gate timing control circuit 76 receives various timing signals including a horizontal synchronizing signal, a vertical synchronizing signal, and a display timing signal to decide the drive timing of the gate line 28 in accordance with an inputted timing signal. Moreover, the gate timing control signal 76 receives the cycle of a horizontal synchronizing signal (length of a horizontal scanning period) measured by a drive timing discrimination circuit 80 to be described later and outputs an instruction for executing the gate overlap scan to the gate line driver 30 when the cycle of the horizontal synchronizing signal is a predetermined value or less.

The gate line driver 30 applies a gate voltage to turn on the TFT 24 connected to any one of the gate lines 28 for a predetermined time in accordance with the drive timing decided by the gate timing control circuit 76 and switches the gate lines 28 to which the voltage is applied one by one for each of the predetermined time. Moreover, when the driver 30 receives an instruction for performing the gate overlap scan, it also applies the gate voltage to a gate line after two lines {(n+2)-th gate line from n-th gate line} to drive it.

The driving circuit 54 fetches data for each picture element from an image data signal only for the effective period in which a display timing signal is kept at the high level and outputs the fetched data for each picture element to the data line driver 34 as image data in parallel every data corresponding to one picture-element string based on the dot clock signal inputted from the information processor 58. The data line driver 34 connects with a reference voltage generation circuit 36 and the drive timing discrimination circuit 80 of the present invention serving as discrimination means in order.

Figure 3:
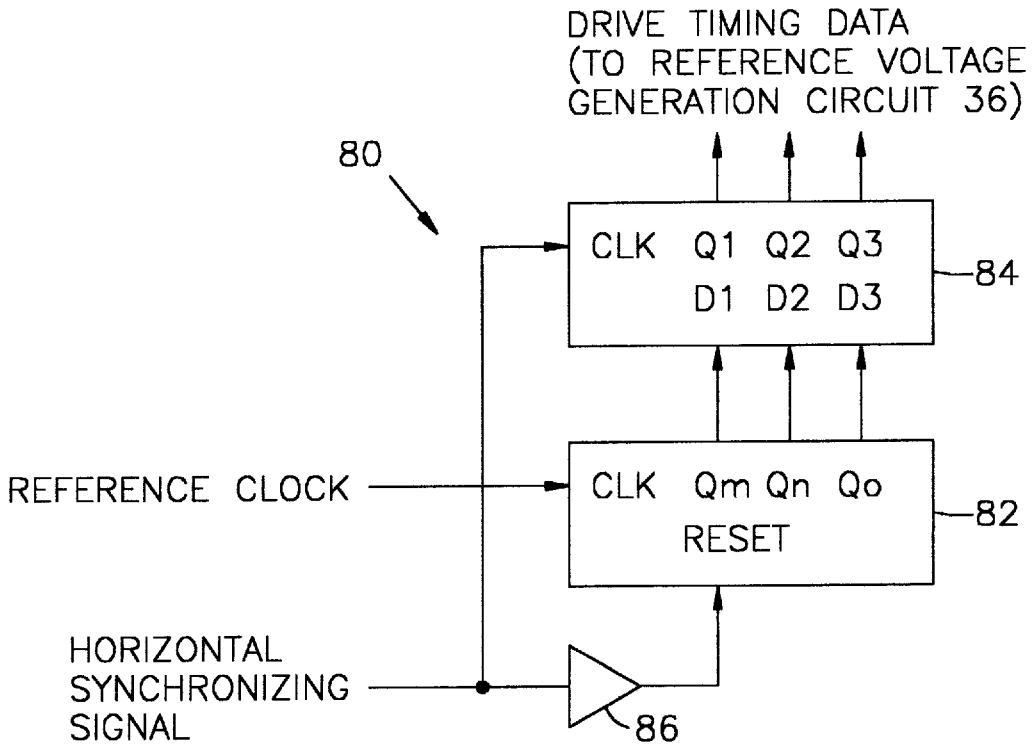
FIG. 3 is a schematic diagram showing a drive timing discrimination circuit.

As shown in FIG. 3, the drive timing discrimination circuit 80 includes a counter 82 and a latch 84. A reference clock signal with a constant frequency is inputted to a clock signal input terminal CLK of the counter 82 and a horizontal synchronizing signal sent from the information processor 58 is inputted to a reset terminal RESET through a delay circuit 86. Counted-value output terminals Qm, Qn, and Qo of the counter 82 are connected to data input terminals D1, D2, and D3 of the latch 84. The horizontal synchronizing signal is also inputted to the clock signal input terminal CLK of the latch 84 and drive timing data is outputted from output terminals Q1, Q2, and Q3 of the latch 84.

The reference voltage generation circuit 36 is provided with gradation-voltage generation and correction circuits 38 (see FIG. 4) equal to the number of gradations of image data (e.g. the number of gradations=$2^3$=8 when image data corresponding to one picture element consists of 3 bits), correspondingly to each gradation represented by the image data. The gradation-voltage generation and correction circuits 38 correspond to the correction means of the present invention. The gradation-voltage generation and correction circuits 38 have the same structure and receive a gradation signal through an input terminal 38A. The gradation signal is a signal in which the voltage level rises as a corresponding gradation lowers in light transmittance of liquid crystal.

The input terminal 38A is branched to a plurality of terminals (three in the case of FIG. 4) and the branched terminals are connected to an analog switch circuit 44. The analog switch circuit 44 is provided with three input terminals and a plurality of output terminals and moreover provided with three switches (though they are conceptually shown as mechanical switches in FIG. 4, they actually comprise a switching element such as a transistor).

The analog switch circuit 44 is connected to the drive timing discrimination circuit 80 through an adder 62. The adder 62 receives drive timing data from the drive timing discrimination circuit 80 and moreover receives gate overlap scan-on/off data showing whether to execute the gate overlap scan from the gate timing control circuit 76. The adder 62 adds the two types of received data and outputs the operation result as control data. The gate overlap scan-on/off data has a predetermined value $D_{OVON}$ when the gate overlap scan is executed and a predetermined value $D_{OVOFF}$ when it is not executed (in this case, $D_{OVON}>D_{OVOFF}$).

The analog switch circuit 44 turns on or off the plurality of switches in accordance with the value of the control data inputted from the adder 62. Three output terminals of the analog switch circuit 44 are connected to one ends of resistances 46A, 46B, and 46C with different electric resistance values from each other and the other ends of the resistances 46A, 46B, and 46C are connected to the inverse input terminal of an operational amplifier 42. A gradation signal with a voltage level in accordance with a respectively corresponding gradation is inputted to the input terminal 38A of the gradation-voltage generation and correction circuits 38. The inverse input terminal of the operational amplifier 42 is connected to an output terminal of the operational amplifier 42 through a resistance 48.

The non-inverse input terminal of the operational amplifier 42 is grounded and the output terminal of the operational amplifier 42 is connected to the inverse input terminal of an operational amplifier 52 through a resistance 50. The inverse input terminal of the operational amplifier 52 is connected to the output terminal of the operational amplifier 52 through a resistance 54 and the non-inverse input terminal of the operational amplifier 52 is grounded. The output terminals of the operational amplifiers 42 and 52 are connected to terminals 56B and 56C of a polarity switching unit 56. Though the polarity switching unit 56 is conceptually shown as a mechanical switch in FIG. 4, it actually comprises a switching element such as a transistor and switches a terminal connected to a common terminal 56A to a terminal 56B or terminal 56C in accordance with a polarity switching signal generated by a horizontal synchronizing signal whenever the LCD 10 is driven by one line. The common terminal 56A is connected to the inverse input terminal of an operational amplifier 60 through the resistance 58.

The gradation-voltage generation and correction circuits 38 are provided with an analog switch circuit 72 having the same structure as the analog switch circuit 44. Three input terminals of the analog switch circuit 72 are connected to a power supply and a constant voltage $V_0$ is supplied to the input terminals. Three output terminals of an analog switch circuit 64 are connected to one ends of resistances 74A, 74B, and 74C with different electric resistance values from each other and the other ends of the resistances 74A, 74B, and 74C are connected to the inverse input terminal of the operational amplifier 64. The non-inverse input terminal of the operational amplifier 64 is connected to a power supply for generating a reference voltage $V_{REF}$ through a resistance 68. The inverse input terminal of the operational amplifier 64 is connected to the output terminal of the operational amplifier 64 through a resistance 66 and the output terminal of the operational amplifier 64 is connected to the non-inverse input terminal of the operational amplifier 60.

The inverse input terminal of the operational amplifier 60 is connected to the output terminal of the operational amplifier 60 through a resistance 70 and the output terminal of the operational amplifier 60 is connected to the output terminal 38B of the gradation-voltage generation and correction circuits 38. In the case of this embodiment, the electric resistance value of the resistance 58 is made equal to that of the resistance 70.

Each output terminal 38B of the gradation-voltage generation and correction circuits 38 is connected to the data line driver 34 and the reference voltage corresponding to each gradation is inputted to the data line driver 34. Therefore, reference voltages equal to the number of gradations of image data are inputted to the data line driver 34 from the reference-voltage generation circuit 36. The data line driver 34 supplies the reference voltage supplied from the gradation-voltage generation and correction circuits 38 corresponding to the gradation of each picture element to the data line 32 corresponding to each of the picture elements in accordance with the gradation of each of the picture elements constituting one picture-element string shown by inputted image data.

Figure 6:
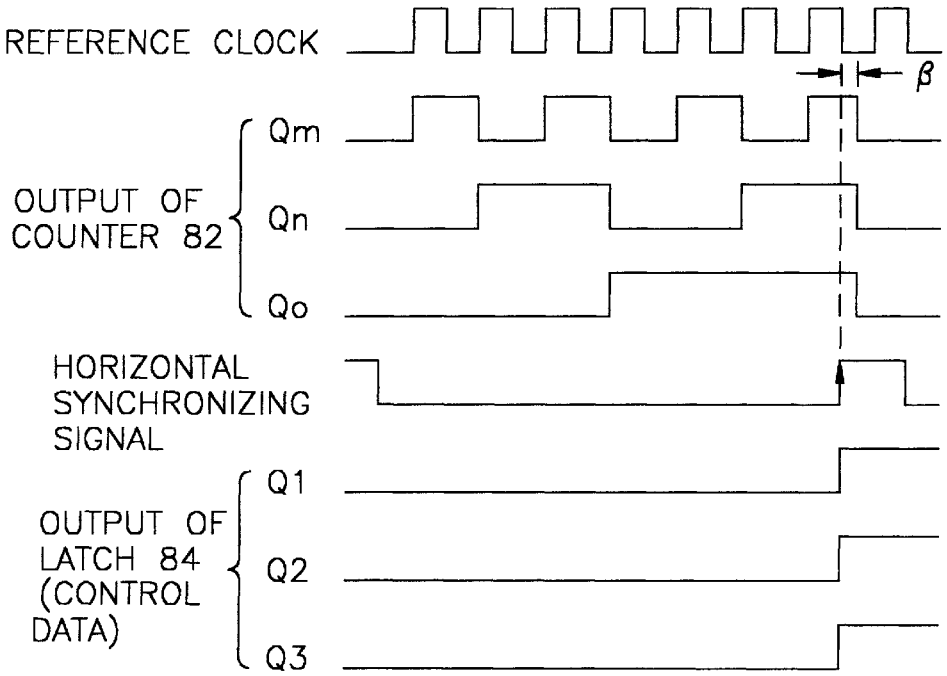
FIG. 6 is a timing chart for explaining operations of a drive timing discrimination circuit.

Operations of this embodiment are described below. The counter 82 of the drive timing discrimination circuit 80 counts the number of pulses of the reference clock signal with a constant frequency (see FIG. 6) inputted through the clock signal input terminal CLK and resets a counted value whenever the pulse of a horizontal synchronizing signal is inputted to the reset terminal RESET through the delay circuit 86. Therefore, the counter 82 counts the time of one cycle of the horizontal synchronizing signal (horizontal scanning period including a blanking period), the level of a signal outputted from the output terminal Qm, Qn, or Qo of the counter 82 successively changes in accordance with the increase of the counted value as shown in FIG. 6, and the counted value is reset whenever the horizontal synchronizing signal inputted to the reset terminal RESET is set to the high level (i.e. every signal outputted from the output terminal Qm, Qn, or Qo is set to the low level).

Moreover, the horizontal synchronizing signal is also inputted to the latch 84 through the clock signal input terminal CLK and the latch 84 captures the data outputted from the output terminal Qm, Qn, or Qo of the counter 82 through the data input terminal D1, D2, or D3 to hold it whenever the inputted horizontal synchronizing signal is set to the high level. Resetting of a counted value by the counter 82 and capturing and holding of the counted value by the latch 84 are performed when an inputted horizontal synchronizing signal is set to the high level. However, because the horizontal synchronizing signal inputted to the counter 82 is delayed by a predetermined time (β in FIG. 6) by the delay circuit 86, a counted value immediately before it is reset is held by the latch 84.

Thus, the data held by the latch 84 is outputted to the adder 62 from the data output terminals Q1, Q2, and Q3 as drive timing data, added with gate overlap san-on/off data in the adder 62, and outputted to the gradation-voltage generation and correction circuits 38 as control data. As described above, the gate overlap scan-on/off data is set so that the value of the data $D_{OVON}$ when the gate overlap scan is performed is larger than the value of the data $D_{OVOFF}$ when the gate overlap scan is not performed. Therefore, the control data shows the length of the period for applying data voltages with the same polarity to liquid crystal (second period of the present invention), and the value of the control data decreases as the horizontal scanning period (gate-on time) shortens and the value gets small when the gate overlap scan is not performed compared to the case in which the gate overlap scan is performed.

The analog switch circuit 44 of the gradation-voltage generation and correction circuits 38 turns on/off three switches in accordance with the value of inputted control data. Specifically, the circuit 44 decreases a synthesized resistance value of resistances connected to corresponding analog switches which are turned on among the resistances 46A to 46C as the value of the control data becomes smaller. A gradation signal is supplied to the inverse input terminal of the operational amplifier 42 through a resistance connected to a turned-on switch. Therefore, a signal in which the absolute value of a voltage level increases as the light transmittance of the liquid crystal shown by a corresponding gradation lowers and the absolute value of the voltage level increases as the value of control data decreases, that is, the length of the period for applying data voltages with the same polarity to the liquid crystal increases is inputted to the inverse input terminal of the operational amplifier 42. Because the operational amplifier 42 operates as an inverting amplifier, the absolute value of a voltage level is proportional to the voltage level of an input signal and a signal with an inverted polarity is outputted.

Figure 7B:
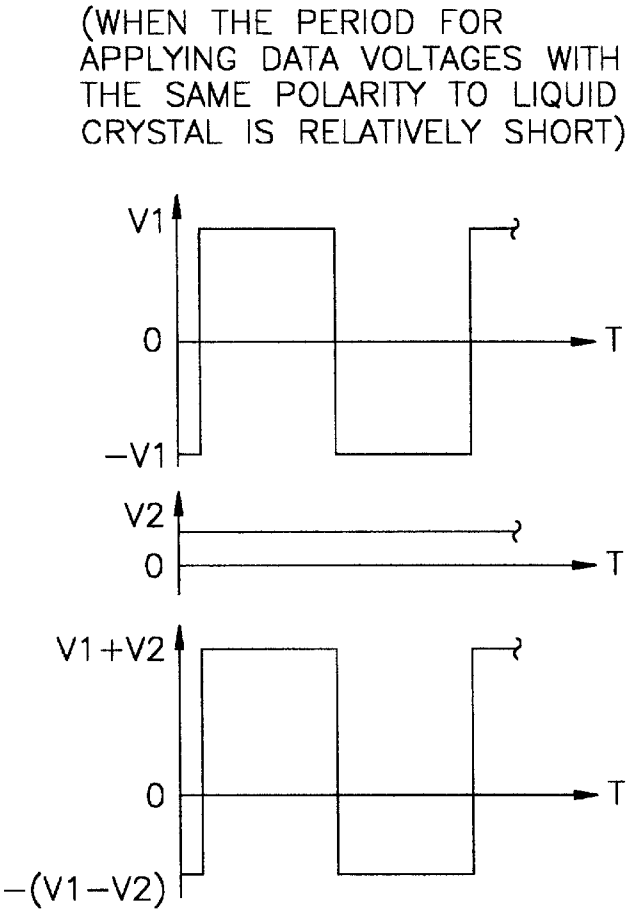
FIG. 7(A) is a diagram showing changes of signals outputted from the polarity switching unit 56 and operational amplifiers 64 and 60 of gradation-voltage generation and correction circuits when the period for applying data voltages with the same polarity to liquid crystal is relatively long and FIG. 7(B) is a diagram showing changes of signals outputted from the unit 56 and amplifiers 64 and 60 of the circuits when the period is relatively short.

An output signal of the operational amplifier 42 is inputted to the inverse input terminal of the operational amplifier 52 through the resistance 50. Because the operational amplifier 52 operates as an inverting circuit, the voltage level of the output signal of the operation amplifier 52 comes to $V_1$ when assuming the voltage level of an output signal of the operational amplifier 50 as $-V_1$. The polarity switching unit 56 switches a terminal to be connected to the common terminal 56A to the terminal 56B to 56C whenever one line of the LCD 10 is driven. For example, as shown in FIG. 7, the unit 56 outputs an output signal of the operational amplifier 42 and an output signal of the operational amplifier 52 by turns. A signal outputted from the polarity switching unit 56 is inputted to the inverse input terminal of the operational amplifier 60 through the resistance 58.

Control data outputted from the adder 62 is also inputted to the analog switch circuit 72. The analog switch circuit 72 increases a synthesized resistance value of resistances connected to corresponding analog switches which are turned on among the resistances 74A to 74C as the value of the inputted control data decreases. Moreover, the reference voltage $V_{REF}$ is inputted to the non-inverse input terminal of the operational amplifier 64 through the resistance 68. The reference voltage $V_{REF}$ is previously adjusted so that it lowers as the light transmittance of the liquid crystal shown by a gradation to which the gradation-voltage generation and correction circuits 38 correspond decreases. Because the operational amplifier 64 operates as a differential amplifier, the voltage level of a signal outputted from the operational amplifier 64 comes to $V_2=\{V_{REF}-V_O\times(R_{66}\div R_{ON})\}$(in this case, $R_{66}$ represents the electric resistance value of the resistance 66 and $R_{ON}$ represents a synthesized resistance value of resistances connected to corresponding switches which are turned on among the resistances 74A to 74C) and a signal in which the potential rises as the period for applying data voltages with the same polarity to liquid crystal decreases (hereafter referred to as correction voltage $V_2$) is outputted.

A correction voltage outputted from the operational amplifier 64 is inputted to the non-inverse input terminal of the operational amplifier 60. The voltage level of a signal outputted from the operational amplifier 60 comes to $V_1+V_2$ when a signal with the voltage level $-V_1$ is inputted from the operational amplifier 42 through the polarity switching unit 56 and comes to $-V_1+V_2$ when a signal with the voltage level $V_1$ is inputted from the operational amplifier 52 through the polarity switching unit 56. Therefore, a voltage obtained by correcting a signal outputted from the polarity switching unit 56 by the correction voltage $V_2$ for each polarity is outputted from the operational amplifier 60.

Figure 7A:
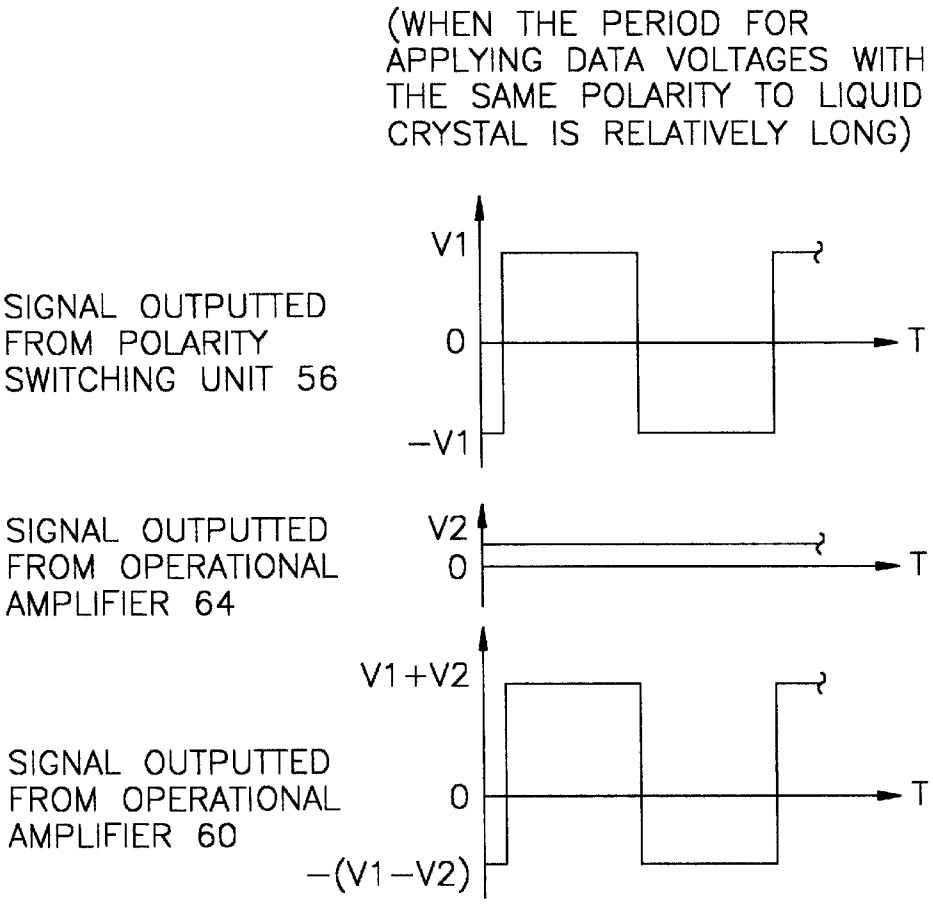

Moreover, the correction voltage $V_2$ is changed in accordance with the length of the period for applying data voltages with the same polarity to the liquid crystal as described above. For example, because the value of control data increases when the above period is relatively lengthened, the amplitude (absolute value of the voltage level $V_1$) of a signal outputted from the polarity switching unit 56 decreases and the potential of the correction voltage $V_2$ lowers, and the voltage level of a signal outputted from the operational amplifier 60 is corrected by the correction voltage $V_2$ whose potential is lowered as shown in FIG. 7(A). Moreover, because the value of control data decreases when the period for applying data voltages with the same polarity to liquid crystal shortens, the amplitude of a signal outputted from the polarity switching unit 56 increases and the potential of the correction voltage $V_2$ rises, and the voltage level of a signal outputted from the operational amplifier 60 is corrected by the correction voltage $V_2$ whose potential rises.

The above signal outputted from the operational amplifier 60 is supplied to the data line driver 34 as the reference voltage. The gate line driver 30 applies a voltage for turning on the TFT 24 to any one of the gate lines 28 for a predetermined time and switches the gate lines 28 for applying the above voltage every predetermined time one by one. The data line driver 34 receives image data showing the gradation of each picture element of a picture element string corresponding to a gate line to which a voltage is applied synchronously with the timing for switching gate lines to which the gate line driver 30 applies a voltage and supplies the reference voltage supplied from the gradation-voltage generation and correction circuits 38 corresponding to the gradation of each picture element to the data line 32 corresponding to each picture element as data voltage in accordance with the gradation of each picture element.

In this case, as shown in FIG. 8, when a voltage is applied to predetermined gate lines 28 while the data voltage has positive polarity, the TFTs 24 connected to the predetermined gate lines 28 are respectively turned on, the data voltage with positive polarity is applied between the electrodes 22 and 20, and the voltage between electrodes changes at a predetermined change rate corresponding to positive polarity and rises up to a predetermined level. Thereby, the light transmittance of the liquid crystal 18 arranged between electrodes changes correspondingly to the voltage level applied between electrodes and electric charges are accumulated in the capacitance of the liquid crystal 18. When a predetermined time passes after applying of the voltage to the predetermined gate lines 28 is started, applying of the voltage to the predetermined gate lines is stopped and the TFTs 24 are turned off. When the TFTs 24 are turned off, the voltage between electrodes lowers by the value $\Delta V$ determined by the parasitic capacitance of the TFTs 24 and the permittivity of the liquid crystal 18 by the influence of the parasitic capacitance of the TFTs 24 and comes to the voltage V. While the TFTs 24 are turned off, the state is kept in which the voltage V is almost applied between electrodes.

The contact of each polarity switching unit 56 of the gradation-voltage generation and correction circuits 38 is switched whenever one line of the LCD 10 is driven. However, the polarity of the data voltage applied to a predetermined line is inverted whenever an image on the LCD 10 is displayed by one frame. When a voltage is applied to predetermined gate lines 28 while the data voltage has negative polarity, TFTs 24 are turned on and data voltage with negative polarity is applied between the electrodes 22 and 20, and the voltage between the electrodes changes at a predetermined change rate corresponding to the negative polarity to lower up to a predetermined level. Moreover, when the TFTs 24 are turned off after a predetermined time passes, the voltage between the electrodes further lowers by ΔV. Furthermore, because data voltages with the same polarity are applied also when the line before two lines is driven at the execution of the gate overlap scan, the period for applying data voltages with the same polarity to liquid crystal increases twofold.

Data voltage is provided with an amplitude corresponding to the length of a period for applying data voltages with the same polarity to liquid crystal in the gradation-voltage generation and correction circuits 38 as described above. Moreover, for each gradation, the amplitude is corrected for each polarity by the correction voltage $V_2$ whose potential changes in accordance with the length of the period and the position (center) of 0 V is offset to the amplitude of the data voltage.

Figure 8B:
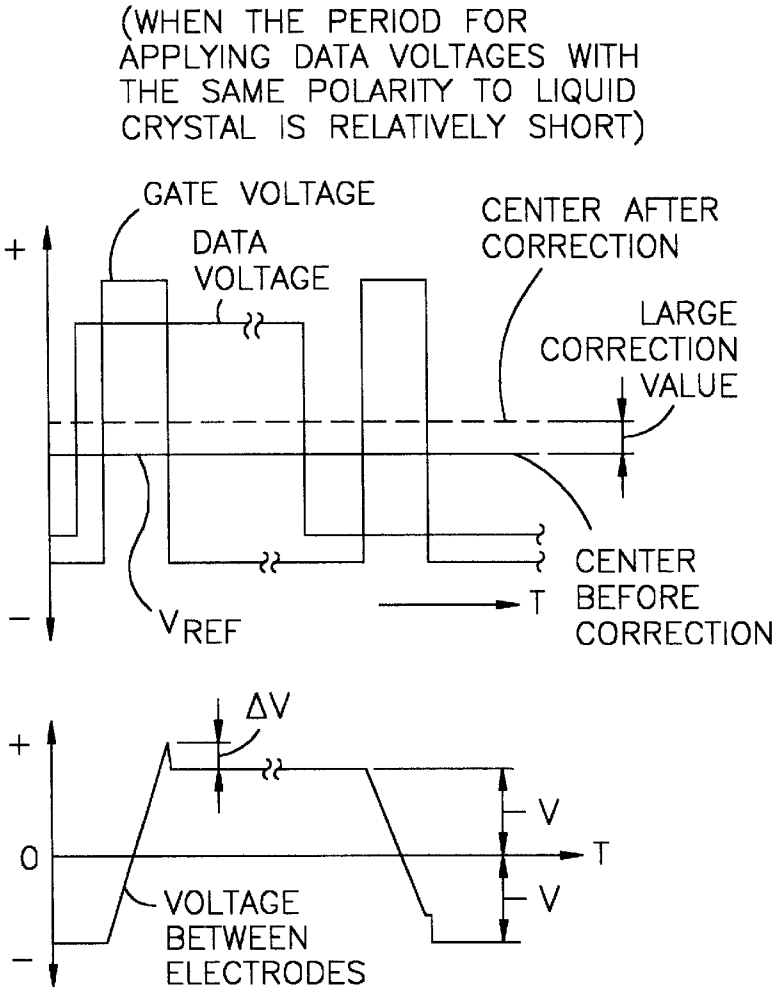
FIG. 8(B) is a diagram showing changes of data voltage, gate voltage, and inter-electrode voltage when the period is relatively short.
Figure 8A:
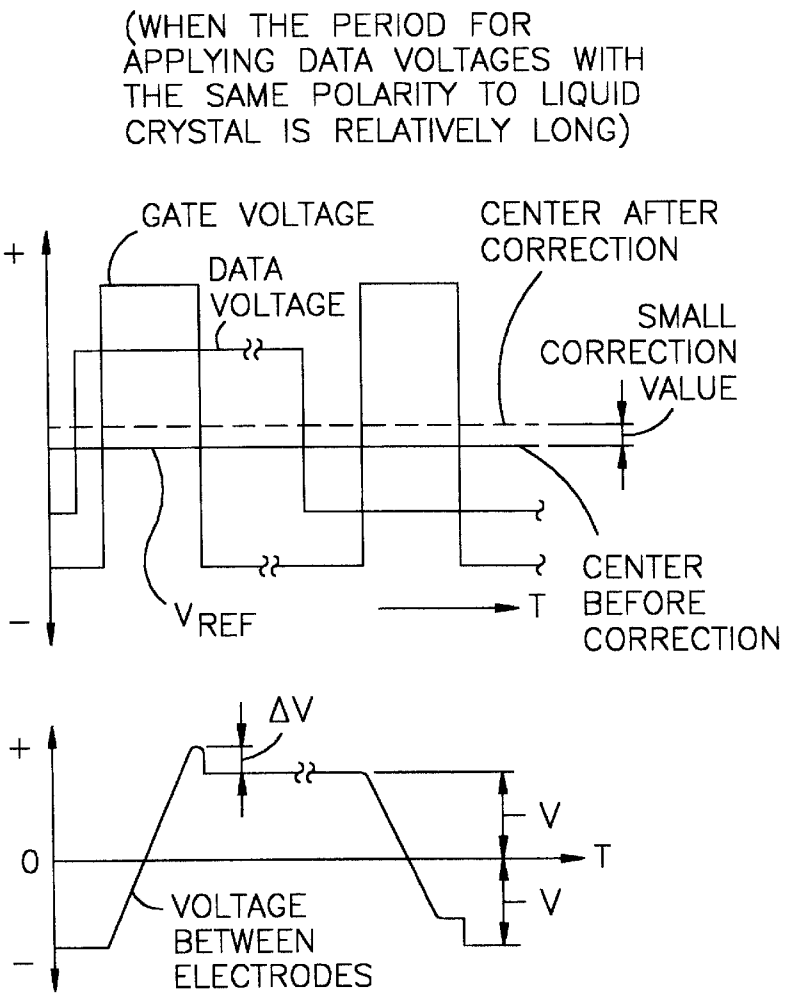
FIG. 8(A) is a diagram showing changes of data voltage, gate voltage, and inter-electrode voltage when the period for applying data voltages with the same polarity to liquid crystal is relatively long

Therefore, when the length of one cycle of a horizontal synchronizing signal outputted from the information processor 58 is long or the gate overlap scan is performed, the period for applying data voltages with the same polarity to liquid crystal is relatively lengthened and, as shown in FIG. 8(A), the amplitude of the data voltage decreases and the offset of the center of the data voltage decreases because the potential of the correction voltage $V_2$ lowers. Thereby, the change rate of the inter-electrode voltage depending on the polarity of the data voltage is corrected, the change ΔV of the inter-electrode voltage after a TFT is turned off is corrected, and the absolute values of inter-electrode voltages when the TFT 24 is turned off are equalized.

Moreover, when the length of one cycle of a horizontal synchronizing signal outputted from the information processor 58 is short and the gate overlap scan is not performed, the period for applying data voltages with the same polarity to liquid crystal is relatively shortened and, as shown in FIG. 8(B), the amplitude of the data voltage increases and the offset of the center of the data voltage increases because the potential of the correction voltage $V_2$ rises. Thereby, the change rate of the inter-electrode voltage depending on the polarity of the data voltage is corrected, the change ΔV of the inter-electrode voltage after a TFT is turned off is corrected, and the absolute values of inter-electrode voltages when the TFT 24 is turned off are equalized even if the period for applying data voltages with the same polarity is shortened.

Therefore, even if the period for applying data voltages with the same polarity to liquid crystal changes, voltages between electrodes after the TFT 24 is turned off are equalized independently of the polarity of a voltage to be applied between electrodes. Therefore, the light transmittance of the liquid crystal 18 is kept constant, no flicker is recognized, and deterioration of the liquid crystal 18 or change of contrast is prevented from occurring.

In each circuit of the gradation-voltage generation and correction circuits 38, the reference voltage $V_{REF}$ is adjusted in accordance with each gradation and the absolute value of the correction voltage $V_2$ outputted from the operational amplifier 64 differs in accordance with the gradation corresponding to each circuit 38. Therefore, even if the reference signal outputted from any circuit of the gradation-voltage generation and correction circuits 38 is applied to the data line 32, voltages between electrodes after the TFT 24 is turned off are equalized independently of the polarity of a voltage to be applied between electrodes.

Figure 4:
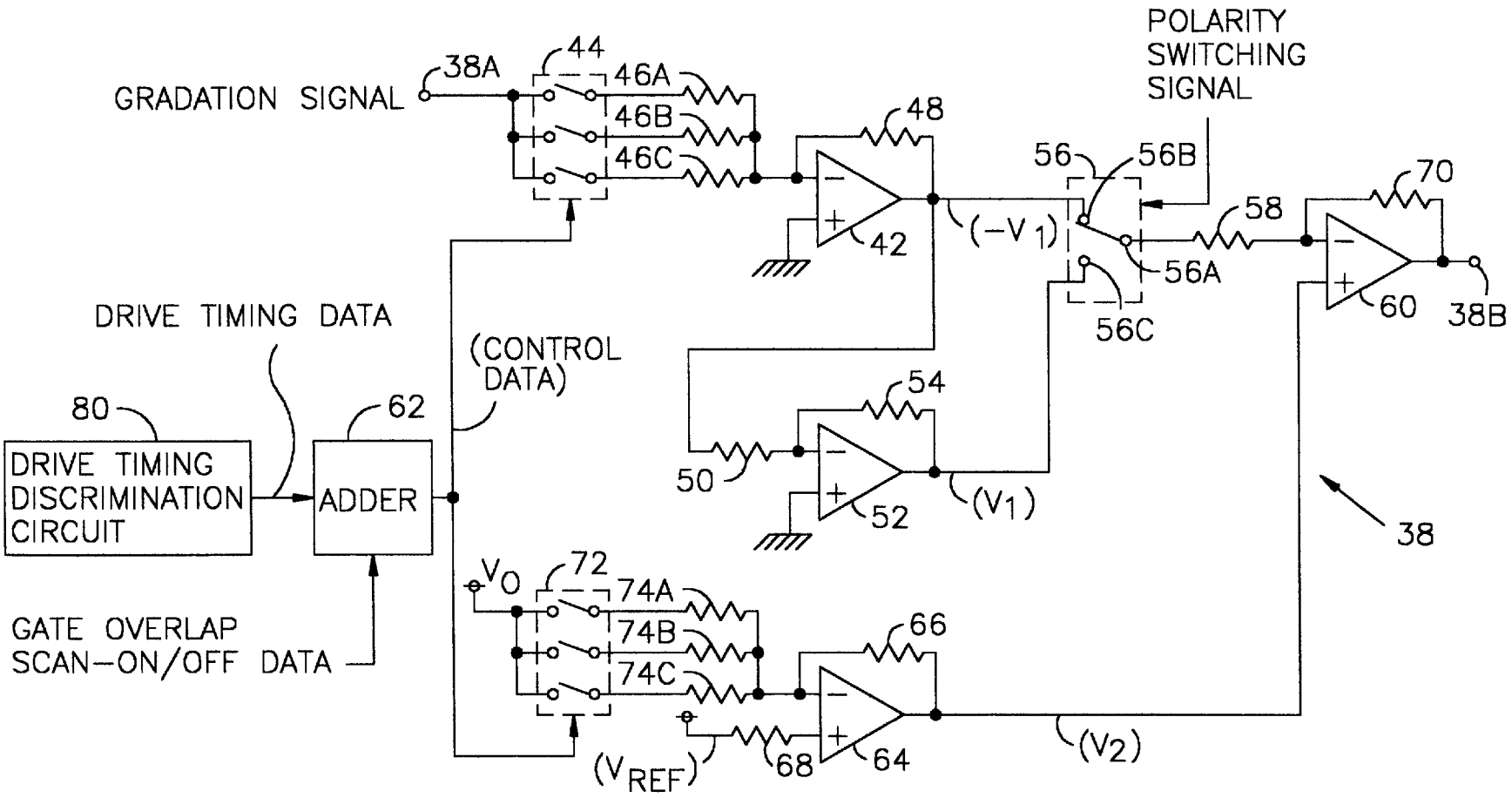
FIG. 4 is a circuit diagram showing a structure of the gradation-voltage generation and correction circuits of the present embodiment.
Figure 9:
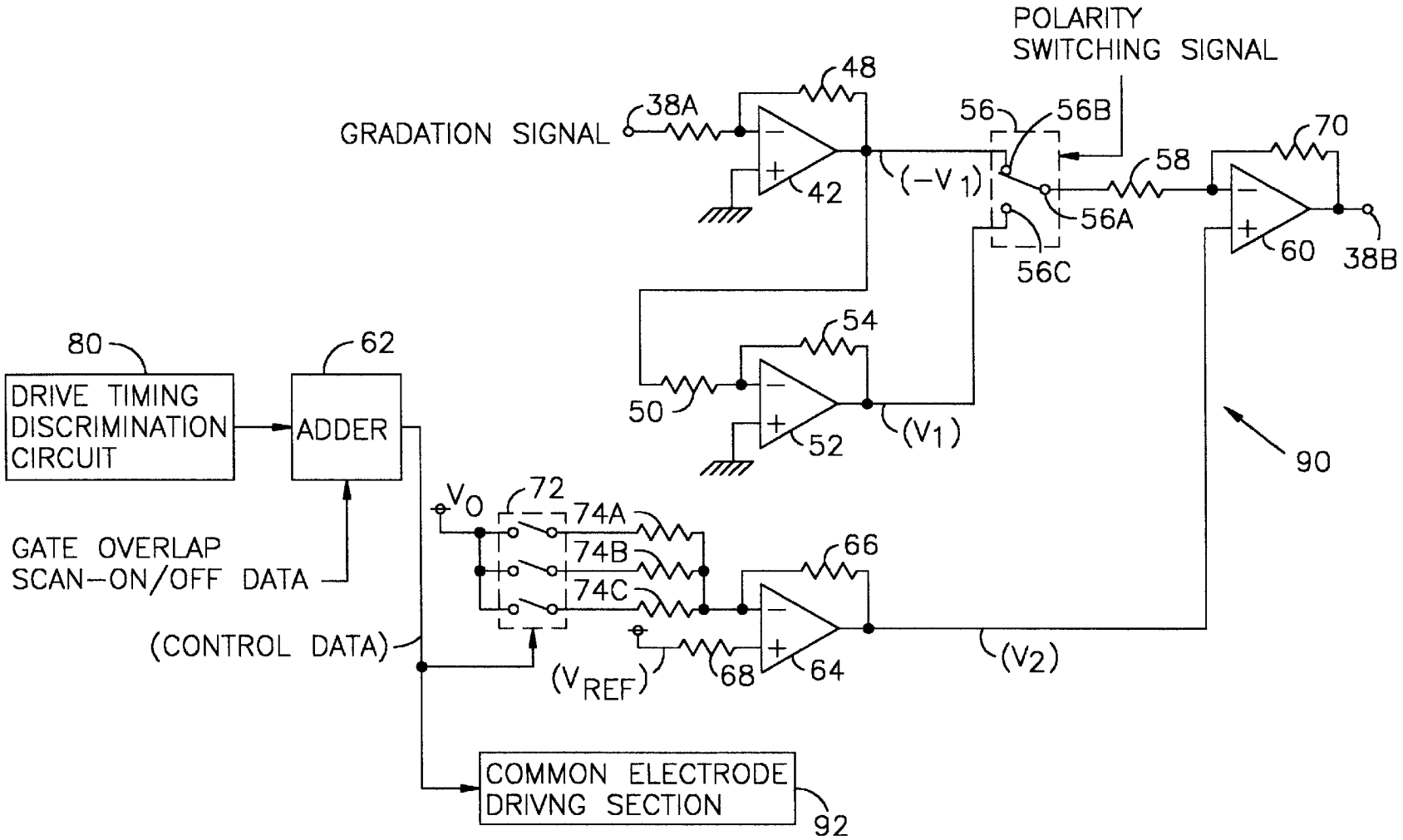
FIG. 9 is a circuit diagram showing another structure of gradation-voltage generation and correction circuits.

The structure of gradation-voltage generation and correction circuits is described below. The same portion as that of the gradation-voltage generation and correction circuits 38 shown in FIG. 4 is provided with the same symbol and its description is omitted. In the case of gradation-voltage generation and correction circuits 90 shown in FIG. 9, non-inverse input terminals of the operational amplifiers 42 and 52 are grounded. Therefore, the absolute value $V_1$ of the voltage level of a signal outputted from the operational amplifier 42 or 52 comes to a constant value corresponding to a gradation. Thus, only the center of the amplitude of the reference voltage (data voltage) outputted from the operational amplifier 60 is changed by the correction voltage $V_2$ (the correction voltage $V_2$ is changed in accordance with the length of the period for applying data voltages with the same polarity to liquid crystal).

Figure 10B:
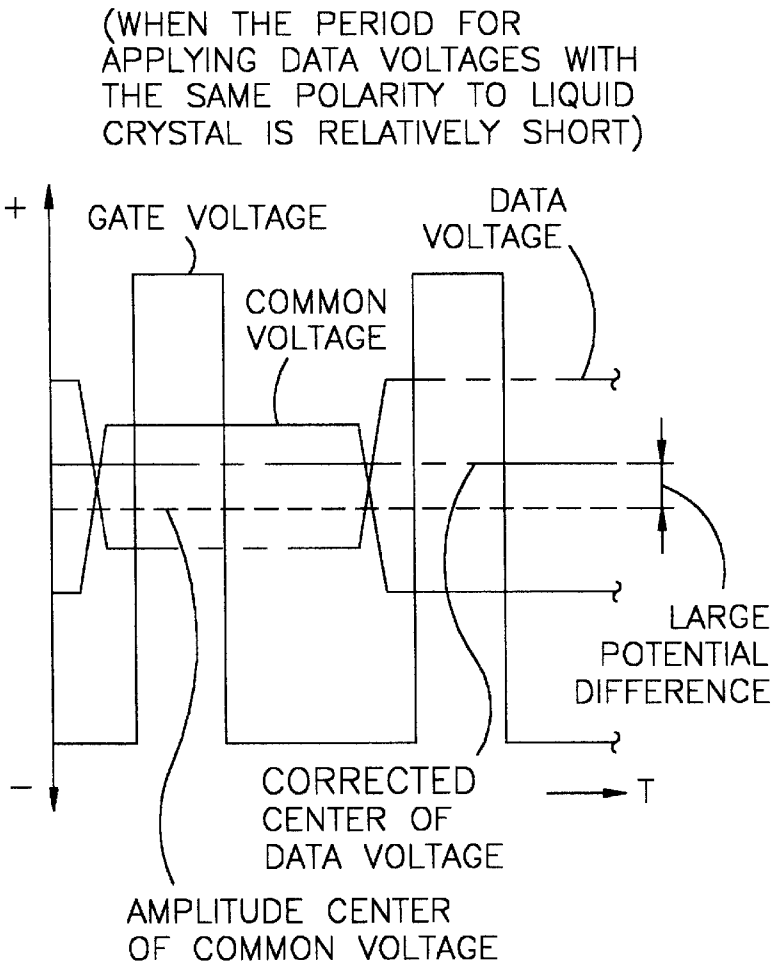
FIG. 10(B) is a diagram showing changes of data voltage, gate voltage, and common voltage when the circuits are used and the period is relatively short.
Figure 10A:
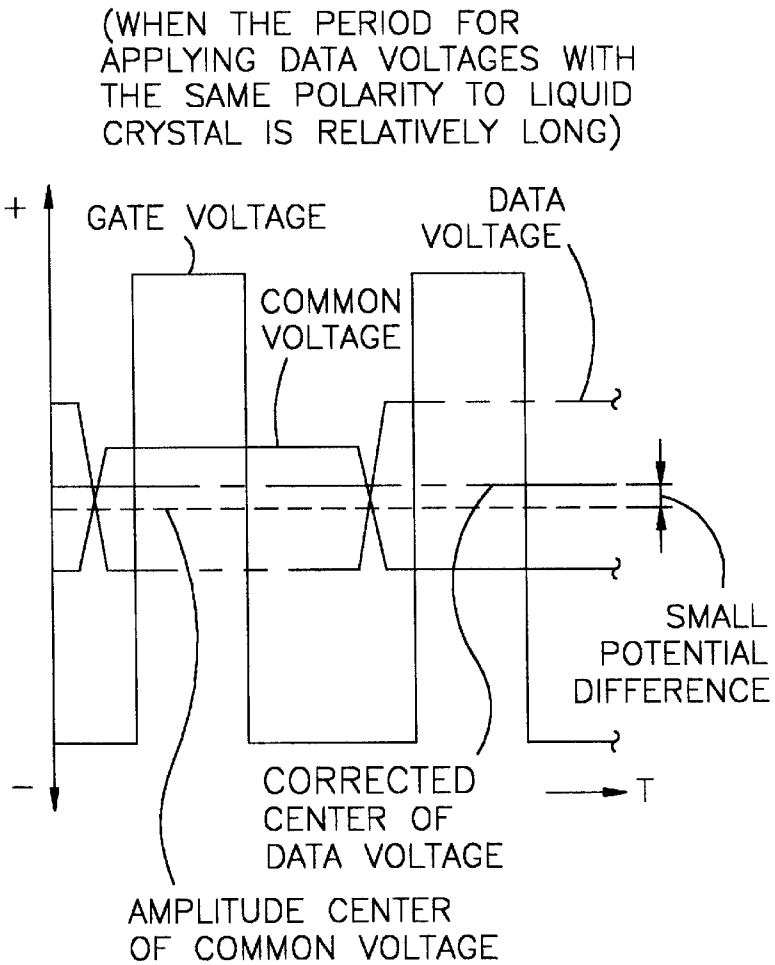
FIG. 10(A) is a diagram showing changes of data voltage, gate voltage, and common voltage when the gradation-voltage generation and correction circuits in FIG. 9 are used and the period for applying data voltages with the same polarity to liquid crystal is relatively long
Figure 11:
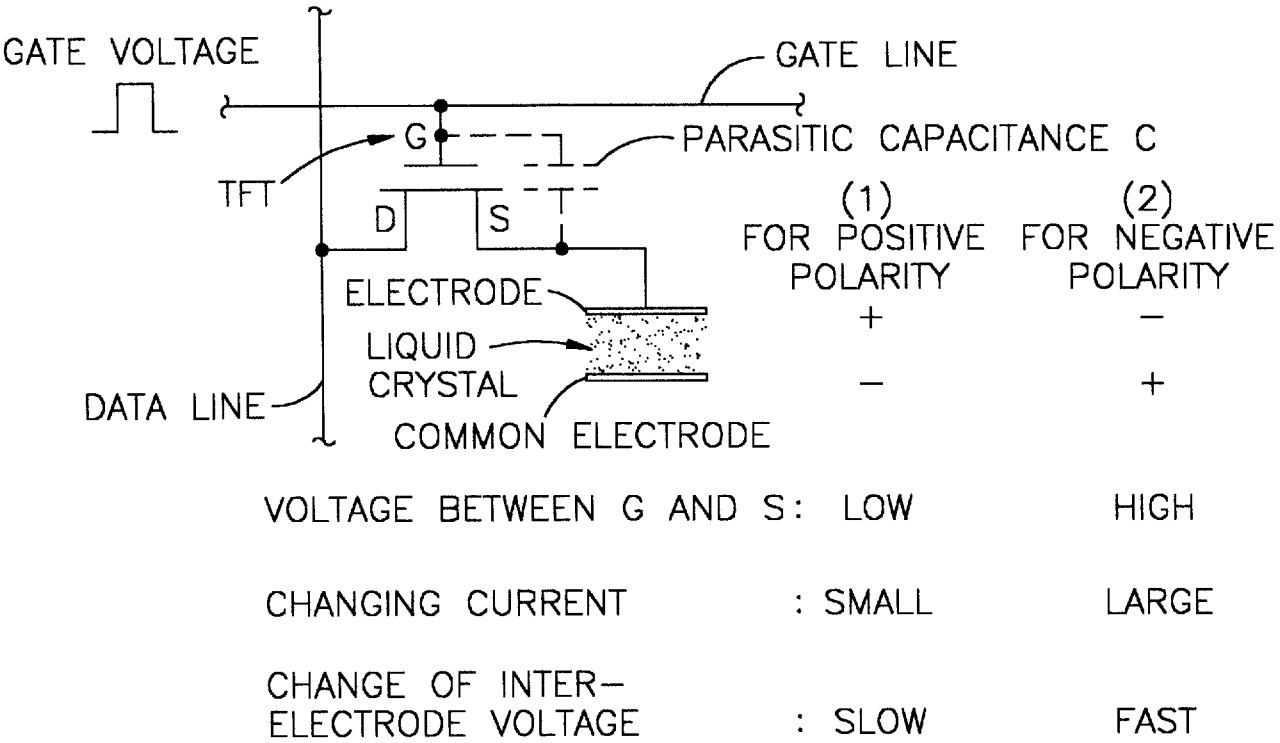
FIG. 11 is an illustration showing a parasitic capacitance of an TFT.
Figure 12A:
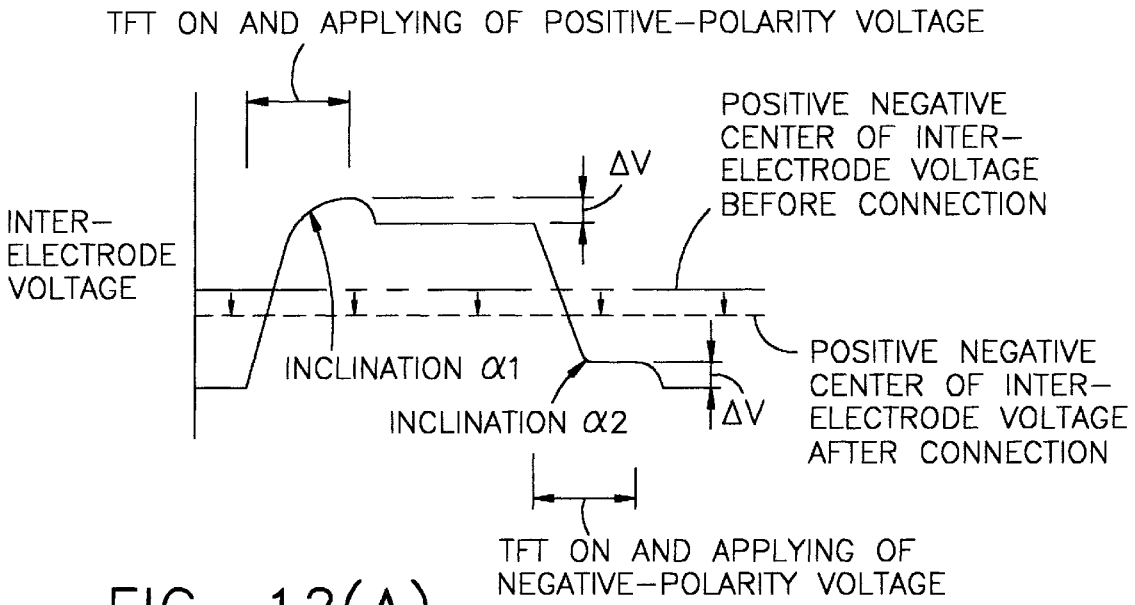
FIGS. 12(A) and 12(B) are diagrams conceptually showing changes of inter-electrode voltage when an LCD is driven, correction of applied voltage according to a gradation having been performed so far, and problems.
Figure 12B:
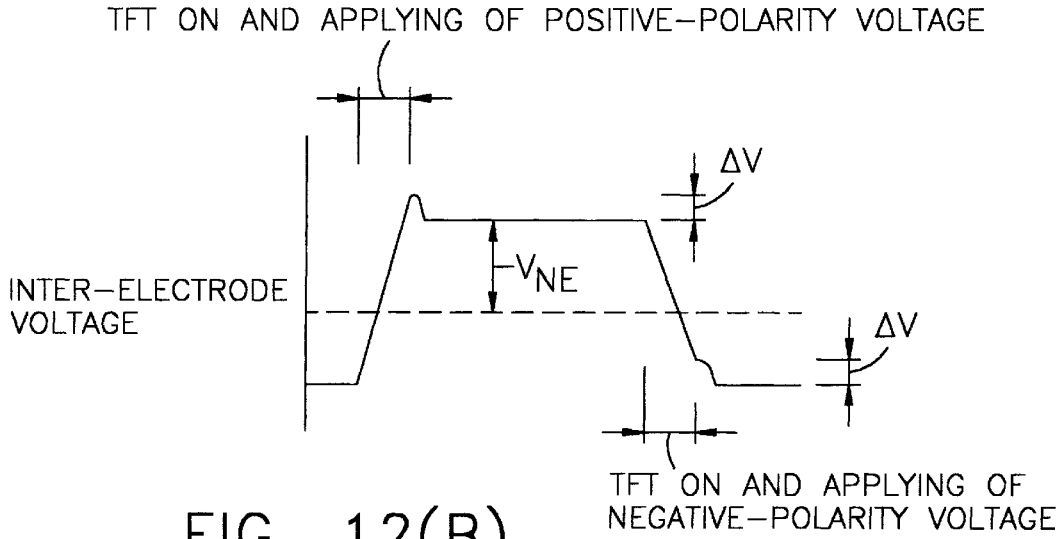

The output terminal of the adder 62 is connected to the input terminal of a common electrode driving section 92 and the output terminal of the common electrode driving section 92 is connected to the common terminal 26 of the electrode 20 (not illustrated). The common electrode driving section 92 receives a polarity switching signal the same as the polarity switching unit 56 does and controls the voltage of the electrode 20 in accordance with the polarity switching signal so that the voltage has a polarity opposite to the polarity of data voltage as shown as the common voltage in FIG. 10 and moreover controls the common voltage so that the amplitude of the common voltage increases as the length of the period for applying data voltages with the same polarity to liquid crystal decreases (the value of control data becomes smaller) as shown in FIGS. 10(A) and 10(B).

Because the difference between data voltage and common voltage is applied between the electrodes 22 and 20, the level of a voltage applied to the liquid crystal 18 at positive polarity and that of a voltage applied to the liquid crystal 18 at negative polarity respectively change in accordance with a change of the length of the period for applying data voltages with the same polarity to liquid crystal similarly to the case of the gradation-voltage generation and correction circuits 38, and flicker, deterioration of the liquid crystal 18, and change of contrast are prevented from occurring similarly to the above mentioned.

Though a case is described above in which a TFT is used as a switching element for turning on/off a voltage applied to liquid crystal, the present invention can be applied to cases of using various switching elements with a parasitic capacitance. Moreover, though the offset of the center of data voltage is changed in the above structure, it is also possible to use a structure for changing the offset of common voltage instead of the above structure.

Moreover, though another case is described above in which liquid crystal having negative dielectric anisotropy that the light transmittance decreases as an applied voltage rises is used as shown in FIG. 5, the present invention is not restricted to the case. It is also possible to apply the present invention to a case of using liquid crystal having positive dielectric anisotropy that the light transmittance increases as an applied voltage rises. When using this type of liquid crystal, it is needless to say that correction must be made so that a correction value increases as the length of the period for applying data voltages with the same polarity to liquid crystal decreases. This problem is easily solved by increasing a synthesized resistance value of resistances connected to turned-on analog switches among the resistances 46A to 46C.

Furthermore, though a display cell comprising the TFT 24, the electrodes 20 and 22, and the liquid crystal 18 is described above, it is also possible to use a display cell constituted by connecting a capacitor in parallel with the liquid crystal 18. Furthermore, though it is described above that the polarity of data voltage is inverted whenever the LCD 10 is driven by one line, it is also possible to invert the polarity of data voltage whenever an image is displayed by one frame.

Furthermore, it is described above that the length of one cycle of a horizontal synchronizing signal is discriminated by counting the number of pulses of the reference clock signal in the drive timing discrimination circuit 80. However, it is also possible to count the number of pulses of a dot clock signal for one cycle of a horizontal synchronizing signal. In this case, an oscillation circuit for generating the reference clock signal is unnecessary.

Furthermore, it is possible to detect the length of one cycle of a vertical synchronizing signal instead of the length of one cycle of a horizontal synchronizing signal or the length of a blanking period in a horizontal or vertical scanning period. Most signals outputted from an information processor conform to any one of various signal standards which are generally known. These signal standards are different from each other in the length of one cycle of horizontal and vertical synchronizing signals. However, it is possible to decide which signal standard a horizontal synchronizing signal outputted from an information processor conform to among various signal standards without detecting the length of one cycle of the horizontal synchronizing signal. Therefore, it is possible to correct the amplitude of data voltage and the center of the amplitude in accordance with the length of one cycle of a horizontal synchronizing signal specified in the decided standard.

As described above, the present invention has the excellent advantage that an image can be displayed on a liquid crystal display at a constant image quality independently of a change of the length of the period for applying voltages with the same polarity to liquid crystal because the absolute values of voltages with positive and negative polarities applied to the liquid crystal while a switching element is turned off are equalized by identifying the time length of on-period of the switching element and correcting the level of gradation voltage for each polarity in accordance with the identified time length.

We claim:

1. A method for driving liquid crystal by alternately applying gradation voltages with positive and negative polarities to a switching element, said method comprising steps of:

identifying a time length during which said switching element is turned on between successive switchings of polarity of applied gradation voltage; and changing the voltage level of the applied gradation voltage for each polarity in accordance with the identified time length, thereby equalizing absolute values of the voltages with positive and negative polarities across said liquid crystal while said switching element is turned off, irrespective of the horizontal scanning period.

2. A method for driving a liquid crystal display having a display cell, said display cell comprising a switching element, a pair of transparent electrodes opposingly disposed with a predetermined spacing, and liquid crystal placed between the pair of transparent electrodes, said display displaying an image by repeating steps of turning on said switching element, applying a voltage with a predetermined polarity and level corresponding to gradation to be displayed on the display cell to the liquid crystal through said pair of transparent electrodes, and then turning off said switching element for a predetermined period while reversing the polarity of said applied voltage to an opposite polarity each time or predetermined plurality of times that the voltage is applied to the liquid crystal, said method comprising the steps of:

determining the length of time that the voltage with the predetermined polarity is applied to the liquid crystal before the voltage with the opposite polarity is applied to the liquid crystal; and changing the level of the voltage applied to the liquid crystal at said predetermined polarity and at said opposite polarity in accordance with the determined length of time so that the absolute values of the voltages between the pair of transparent electrodes while the switching element is turned off are equalized when applying said changed voltage to the liquid crystal at said predetermined polarity and when applying said changed voltage to the liquid crystal at said opposite polarity, irrespective of the horizontal scanning period.

3. A driver for a liquid crystal display for driving liquid crystal by alternately applying gradation voltages with positive and negative polarities to a switching element, said driver comprising:

means for identifying a time length while said switching element is turned on; and means for correcting the voltage level of the gradation voltage for each polarity in accordance with the identified time length and thereby equalizing absolute values of the voltages with positive and negative polarities applied to said liquid crystal while said switching element is turned off, irrespective of the horizontal scanning period.

4. A driver for a liquid crystal display having a plurality of display cells, one of said display cells comprising a switching element, a pair of transparent electrodes opposingly disposed with a predetermined spacing, and liquid crystal placed between the pair of transparent electrodes, said display displaying on the plurality of cells an image by repeating steps of turning on said switching element, applying a voltage with a predetermined polarity and level corresponding to gradation to be displayed on said one display cell to said pair of transparent electrodes, then turning off said switching element for a predetermined period, and reversing the polarity of said applied voltage each time or each predetermined plurality of times that said voltage is applied to the liquid crystal, said driver comprising:

decision means for determining the length of time that said voltage with the predetermined polarity is applied to the liquid crystal before the polarity of said voltage is reversed; and correction means for changing the level of said voltage applied to the liquid crystal of each display cell in accordance with said determined length of time for each polarity so that the absolute values of the voltages between the pair of transparent electrodes while the switching element is turned off are equalized at both polarities of applied voltage, irrespective of the horizontal scanning period.

5. The liquid crystal display driving apparatus according to claim 4, wherein said decision means determines said length of time in accordance with the number of times said voltage with a predetermined polarity is applied to the liquid crystal before the polarity of said voltage is changed and the voltage applying time for each time.

6. The liquid crystal display driving apparatus according to claim 4, wherein said decision means decides said voltage applying time for each time in accordance with a signal for specifying inputted display timing.

* * * * *